US006158429A

United States Patent [19]

Gardner et al.

[11] Patent Number: 6,158,429

[45] Date of Patent: Dec. 12, 2000

[54] HOOD RESPIRATOR FOR PROTECTION AGAINST BIOLOGICAL HAZARDS

[75] Inventors: Paul D. Gardner, Bel Air; Linda C. Strickler, Edgewood, both of Md.

[73] Assignee: The United States of America as represented by the Secretary of the Army, Washington, D.C.

[21] Appl. No.: 09/185,261

[22] Filed: Oct. 26, 1998

[51] Int. Cl.[7] ..... A62B 7/10

[52] U.S. Cl. ..... 128/201.25; 128/201.22

[58] Field of Search ..... 128/201.22–201.25, 128/201.29, 201.15, 200.27, 200.26, 201.28

[56] References Cited

U.S. PATENT DOCUMENTS

| | | | |
|---|---|---|---|
| H863 | 1/1991 | Kwiedorowicz et al. | 2/424 |
| H1360 | 10/1994 | Grove et al. | 128/201.25 |
| 1,845,460 | 2/1932 | Watters | 128/201.15 |
| 2,821,192 | 1/1958 | Monro | 128/201.15 |
| 4,231,118 | 11/1980 | Nakagawa | 2/7 |
| 4,382,440 | 5/1983 | Kapp et al. | 128/201.25 |
| 4,677,976 | 7/1987 | Fujinuma et al. | 128/201.25 |
| 4,761,324 | 8/1988 | Rautenberg et al. | 428/198 |
| 4,807,614 | 2/1989 | Van Der Smissen et al. | 128/201.23 |
| 4,932,078 | 6/1990 | Jones et al. | 2/70 |
| 5,016,625 | 5/1991 | Hsu et al. | 128/201.25 |
| 5,119,808 | 6/1992 | Marquardt et al. | 128/201.22 |
| 5,140,980 | 8/1992 | Haughey et al. | 128/201.25 |
| 5,625,902 | 5/1997 | Drews et al. | 2/205 |
| 5,651,810 | 7/1997 | Flaherty et al. | 95/287 |
| 5,714,126 | 2/1998 | Frund | 422/122 |
| 5,875,775 | 3/1999 | Nur et al. | 28/201.28 |

FOREIGN PATENT DOCUMENTS

| | | | |
|---|---|---|---|
| 2008413 | 6/1979 | United Kingdom | 128/201.15 |

*Primary Examiner*—Aaron J. Lewis
*Assistant Examiner*—Teena Mitchell
*Attorney, Agent, or Firm*—Ulysses John Biffoni; Vincent J. Ranucci

[57] ABSTRACT

An air purifying respirator hood, or more particularly, an air purifying, particulate respirator hood suitable for protection against biological hazards in military and civilian environments. The respirator hood includes an elastic fabric material which blocks the penetration of liquids and airborne particulate contaminants including biological aerosols, yet allows the transmission of moisture vapor and heat transfer to improve user comfort. It also includes at least one HEPA filter, at least one transparent lens, and a breathe-through airflow valve assembly.

14 Claims, 2 Drawing Sheets

HOOD RESPIRATOR FOR PROTECTION AGAINST BIOLOGICAL HAZARDS

GOVERNMENT INTEREST

The invention described herein may be manufactured, licensed, and used by or for the U.S. Government.

BACKGROUND OF THE INVENTION

1. Field of the Invention

The present invention pertains to air purifying hood masks, or more particularly to air purifying, particulate respirator hoods for use in contaminated military environments.

2. Description of the Related Art

Air purifying, respiratory protective devices currently used by the military for protection against chemical and biological contaminants impose a substantial physiological burden on the wearer. These respirators (masks) are difficult to wear for prolonged periods because they are relatively bulky and heavy, have high breathing resistance, impair vision and communications, cause thermal stress and discomfort, and degrade job performance. Most of the encumbrance associated with wearing military masks is attributed to the filter element that is specifically designed to protect against a broad spectrum of chemical warfare agents. Military mask filters typically contain two types of media; an activated carbon media for gas/vapor adsorption and a high efficiency particulate air (HEPA) media to protect against aerosol threats such as agents of biological origin (e.g., bacteria, viruses, and toxins). These filters are inherently bulky and have high breathing resistance (45–55 mm $H_2O$). A number of military and civilian uses exist where protection against biological agents or other particulate hazards is the sole concern. Such scenarios only require an air-purifying particulate respirator equipped with a HEPA filter that by definition is capable of removing at least 99.97% of all airborne particulate hazards in the form of aerosols. There are a number of commercially available half-mask, full-facepiece, and hooded escape respirators that could be used for biological protection. However, all of these have significant shortcomings that are overcome by the present invention. Although lighter in weight and less burdensome, the main shortcoming of half-mask respirators is that they do not seal as well as full-facepiece masks and escape hood respirators with a tight-fitting neck seal. Another disadvantage of half-masks is that they offer no protection for biological agents that harm and/or enter via the eyes. Full face respirators provide eye protection, however, their main disadvantages are that they are bulky, heavy, and uncomfortable and thus difficult to wear for prolonged periods of time. Commercially available escape hood respirators, also known as self-rescue respirators or smoke hoods, also protect the eyes, however, these devices are designed for only short-term protection, for example during self-rescue from a fire. Although they may provide adequate protection against certain gas, vapor, and particulate contaminants such as fire combustion products, most air-purifying escape hoods are not equipped with a HEPA-quality filter and thus afford insufficient protection against submicron aerosol hazards such as biological warfare agents. The major disadvantage of currently available escape hood respirators is that they are constructed of air-impermeable materials that impose a significant heat burden to the wearer. Fogging of the facepiece lens is also a serious problem with escape hood respirators due to perspiration and heat buildup under the hood. Another potential problem is the buildup of harmful levels of carbon dioxide within the hood. This is especially true of escape hoods that are not equipped with a nosecup and are loose fitting. As a result, escape hoods can only be worn for a short period of time. The invention described herein overcomes the shortcomings described above with current state-of-the-art air-purifying HEPA hood respirators that could be used for protection against biological hazards. Unlike commercial escape hood respirators, the present invention has several unique design features that enable it to be worn for extended periods of time. A high-tech, elastic, "breathable" fabric provides a lightweight, form-fitting, comfortable hood that permits moisture to escape yet is impermeable to aerosols. The hood is also equipped with low-resistance, electrostatic HEPA filters and incorporates an air management system to prevent fogging. These and other unique features function together to greatly increase user comfort and wear time. The hood benefits a military or civilian user whose duties demand a less cumbersome, more comfortable, highly protective respirator to prevent exposure to biological warfare agents. For example, the hood could be used to protect law enforcement, security, and health care personnel who are responsible for the evacuation, transportation, and treatment of biological casualties resulting from a terrorist attack. Likewise, Special Forces and other military users could use the hood as a precautionary measure for reconnaissance missions or for sleeping when a less encumbering lower level protective posture is required. In addition to military and counter-terrorism operations, the present invention has potential commercial applications. For example, the hood could be used in the health care industry for protection against airborne infectious diseases such as tuberculosis. The HEPA-quality particulate filters allow the hood to be worn by workers for protection against hazardous industrial aerosols such as asbestos and lead dust.

SUMMARY OF THE INVENTION

The invention provides a respirator assembly which comprises a hood capable of enclosing the head and neck of a human user, said hood comprising a material capable of heat and moisture vapor transmission but which prevents the transmission of particulates and liquids therethrough; at least one transparent lens positioned within said hood at the level of the eyes of the user; at least one filter assembly positioned within and extending through the hood, said assembly comprising a HEPA filter media retained within a screen mesh material, and an airflow deflector; and a breathe-through airflow assembly.

DETAILED DESCRIPTION OF THE PREFERRED EMBODIMENT

Figure 1:
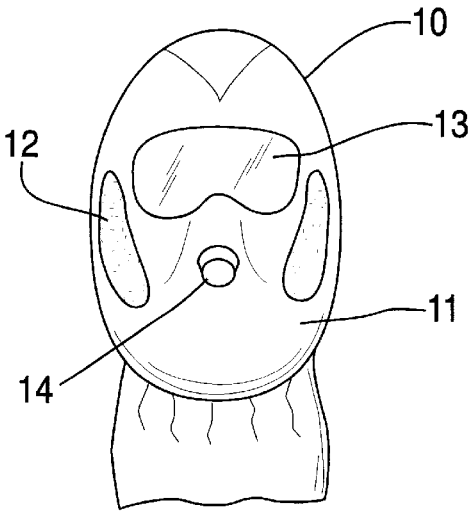
FIG. 1 is a front view of the hood according to the invention.
Figure 2:
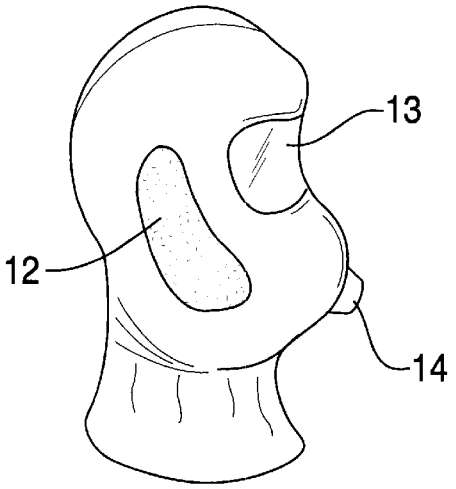
FIG. 2 is a side view of the hood according to the invention.
Figure 4:
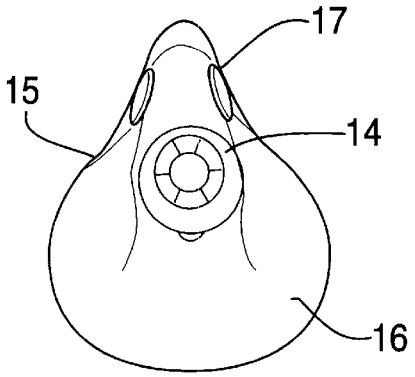
FIG. 4 is a front view of the internal nosecup assembly portion of the inventive hood.
Figure 8:
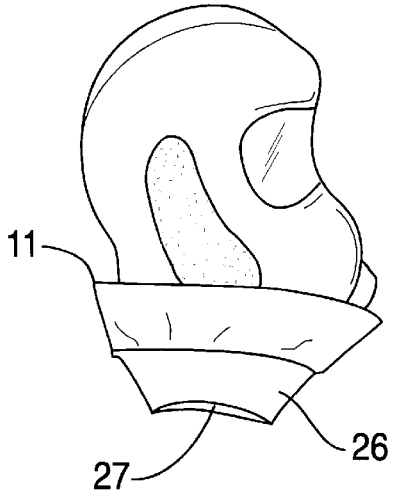
FIG. 8 is a side view of the hood with the bottom of the hood folded and revealing the neckdam seal.

Referring to FIGS. 1 and 2, there is shown a hooded respirator assembly 10 according to the invention. It comprises a hood 11 which is form fitting to the head and neck of the user. It has at least one and preferably two integral HEPA filter elements 12, a clear eye lens 13, a breathe-through airflow assembly 15 preferably having a nosecup 16 as shown in FIG. 4, and a neckdam 26 as shown in FIG. 8.

Figure 3:
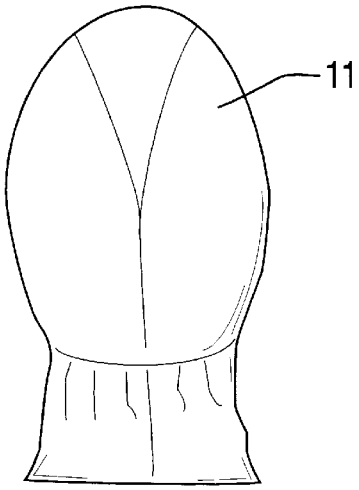
FIG. 3 is a rear view of the hood according to the invention.

A key feature of the inventive air-purifying respirator assembly 10 is the material used to construct the hood 11. The material comprises a lightweight, breathable, stretchable fabric which blocks the penetration of airborne particulate contaminants and is highly resistant to liquid water penetration, yet allows for transmission of moisture vapor. It is also highly resistant to wind. In the preferred embodiment, the hood material identified is an omni-directional stretch fabric available commercially from Darlington Fabrics Corporation, New York, N.Y. under the tradename DARLEXX®. Such material is more fully described in U.S. Pat. No. 4,761,324, which is incorporated herein by reference. The most preferred material is DARLEXX® 3645 fabric. This material has a bias weight of 364 gm/m$^2$ and is constructed of three layers. The middle layer is a hydrophilic, thermoplastic, urethane film that is bonded on each side to a layer of stretchable fabric containing approximately 80% nylon and 20% spandex elastomer. The film effectively prevents the penetration of particulate contaminants and yet is "breathable" in the sense that it allows for moisture-vapor transmission. The film also serves as an effective barrier to wind and water. Other laminated breathable fabrics, such as those made from GORE-TEX materials from W. L. Gore & Associates, Inc., Elkton, Md., are also useful for the construction of the hood. One particular main advantage of DARLEXX® fabric is its unique combination of elasticity coupled with waterproof-breathable stretch which allows the hood to be form fitting, thereby greatly increasing the fit and comfort of the respirator. The fabric's ability to transport water vapor significantly reduces thermal stress caused by heat and moisture build up. This is a problem found in other hood respirators made of rubber (e.g., latex, silicone, butyl rubber, etc.) and other impermeable (non-breathable) materials. As illustrated in FIGS. 2 and 3, two seams preferably run along the top of the hood 11 and join at the front and back of the head to form a conformal shape. As may be apparent to one skilled in the art, other hood seam patterns may be used to produce a form fit to the wearer's head. Each fabric seam is sewn and the inside taped using a suitable adhesive to produce an effective seal.

Figure 6:
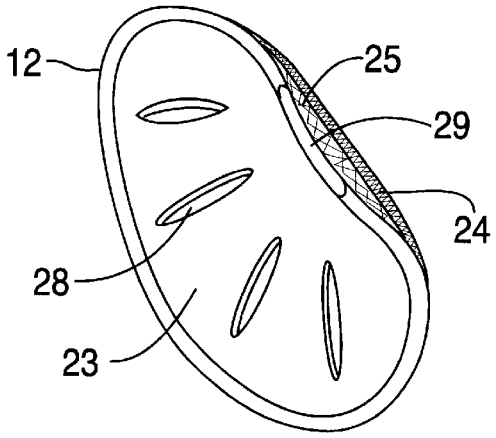
FIG. 6 is a left side view of an assembled HEPA filter element.
Figure 7:
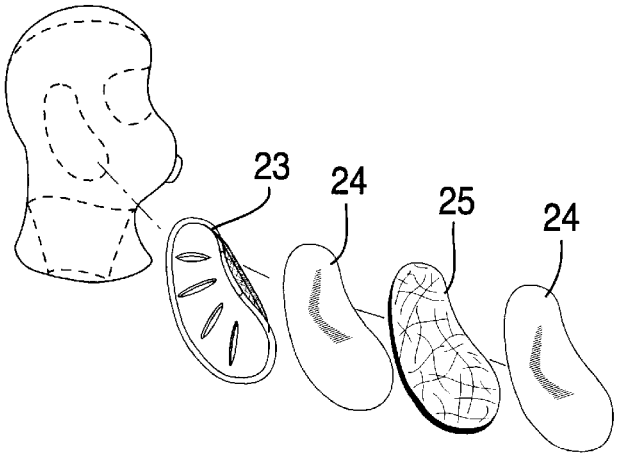
FIG. 7 is an exploded right side view of the HEPA filter element.

The respirator assembly then has at least one and preferably two kidney shaped filter elements 12 bonded to the hood material as shown in FIG. 1. The filter elements 12 comprise a low-resistance, electrostatic, particulate filter media 25 having a minimum collection efficiency of 99.97%. Preferably they are two mirror image filters set on the left and right sides of the hood. Referring to FIGS. 6 and 7, the preferred filter is a kidney-shaped filter element 12 comprising an approximately ¼ inch thick bed of HEPA media 25 and an airflow deflector 23 bonded together to form a single unit. The HEPA media 25 shown in FIG. 7 can comprise any of a number of suitable flat-sheet, electrostatically charged, air filtration media (electrets) which are commercially available. Electret media is used in the present invention since it provides lower breathing resistance than traditional mechanical filtration media. A cover scrim 24 made of thin screen mesh material such as nylon protects the outside and inside surface of the filter media. The airflow deflector 23 is comprised of a soft plastic material with ridges 28 to prevent airflow blockage. As shown in FIG. 6, ridges 28 together with scrim 24 form a plenum for directing airflow through a vent 29 which directs air over the lens for reducing lens fogging. The airflow deflector 23 may be made by thermoforming a 60-mil sheet of Santoprene, which is commercially available from McMaster-Carr of Aurora, Ohio or it can be molded from an alternative soft, flexible plastic material. A primary purpose of the airflow deflector 23 is to direct filtered air across the eye lens to prevent fogging. The entire filter element 12 is less than one-half inch thick and is positioned on the inside of the hood to produce a low profile, contoured fit as shown in FIG. 7. The effective surface area of each filter element 12 is approximately 100 square centimeters in order to provide at least 99.97% aerosol collection efficiency with less than 20 millimeters of water breathing resistance at a breathing rate of 85 liters per minute. The elements are bonded to the hood material with silicone adhesive or other suitable adhesive. Alternate means to integrate the HEPA filtration media 25 and airflow deflector 23 and seal the assembled filter element 12 into the hood can be used as deemed practical by one skilled in the art.

A clear lens 13 is provided that is sized and shaped to allow a wide horizontal and lateral field of view. The lens 13 is comprised of a clear, thin, flexible, plastic material. The preferred lens material is a 60-mil cast-formed polyurethane which has excellent optical properties, durability, and flexibility. Other suitable materials such as clear thermoplastic polyvinyl chloride can also be used to form the lens.

Figure 5:
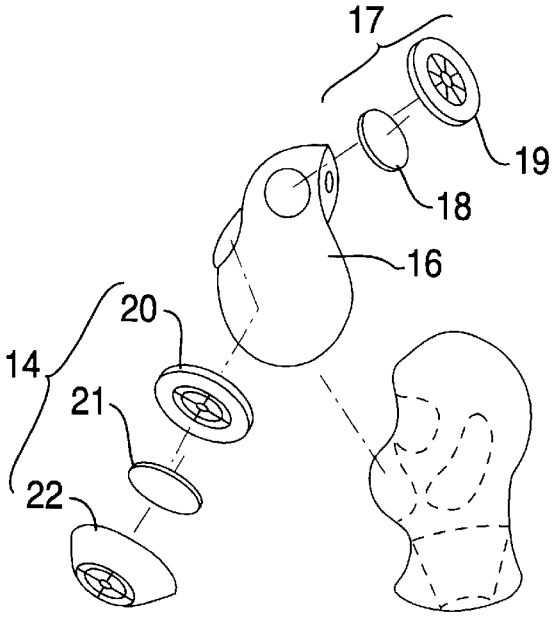
FIG. 5 is an exploded view of the nosecup assembly showing the component parts.

Referring to FIGS. 4 and 5, the respirator assembly has an airflow assembly 15 which allows for proper respiratory airflow management and lens defogging. In the preferred embodiment, the airflow assembly 15 comprises a nosecup 16 which can be made of silicone or another suitable elastomer that is hypoallergenic and provides a comfortable, flexible seal. A modified North 7700 Series silicone, half-mask facepiece available commercially from North Safety Products, Cranston, R.I. is particularly suitable for the nosecup design. The nosecup 16 is designed with a contoured sealing flange and extended side flanges to provide a comfortable and effective seal. The airflow assembly 15 preferably has a centrally located exhalation valve assembly 14 and two inhalation valve assemblies 17 mounted on each side near the bridge of the nose. As seen in FIG. 5, the exhalation valve assembly 14 has a plastic seat 20, a rubber flapper valve 21, and a protective cover 22. The valve 21 opens to permit carbon dioxide ($CO_2$) and moisture to escape from the nosecup during exhalation. The invention preferably uses the exhalation valve assembly provided with the North 7700 Series facepiece. Alternate low-resistance commercially available exhalation valve assemblies having a size and shape compatible with the nosecup and hood design can also be used. The inhalation valve assemblies 17 used in the present invention can be obtained from the nosecup of a M40A2 chemical/biological protective mask. Preferably each inhalation valve assembly 17 has a plastic seat 19 and a thin rubber flapper valve 18. The inhalation valves 18 open during inhalation and close during exhalation to prevent $CO_2$ and heat buildup under the hood. The breathe through airflow assembly 15 is provided to allow exhaled air to escape while preventing inward leakage of contaminants during inhalation. The elastic contoured hood design eliminates the need for nosecup retention straps. This feature, along with the use of a contoured tight fitting nosecup 16, prevents $CO_2$ buildup by reducing the respiratory dead air space inside the hood.

As shown in FIG. 8, the respirator assembly also preferably has a neckdam 26 which provides a respirator-sealing interface for the hood. The neckdam 26 is preferably composed of a thin sheet of silicone rubber. Silicone rubber is used since it is comfortable, highly elastic, and hypoallergenic. The invention preferably uses a 20 mil thick sheet of high purity silicone rubber which is commercially available as No. 86435K21 from McMaster-Car, Aurora, Ohio, since it has been found to have adequate strength and flexibility to avoid being torn when stretched over the head when donned. The neckdam 26 is molded to form a tapered opening 27 that is designed to maximize skin contact and fit snuggly around the neck to ensure a leak proof seal. The opening 27 has a slight elliptical shape, approximately 5 inches in length, and is die cut to prevent tearing when the hood is donned. The neck seal is designed to fit at least 95% of the adult male and female population. Alternative neck seal thicknesses and opening sizes and shapes could be evaluated for optimum fit, seal, and comfort and used in the design as deemed necessary by one skilled in the art.

It is to be understood that the foregoing preferred embodiment is provided for illustrative purposes, and is not intended to limit the scope of the invention in any way.

What is claimed is:

1. A hood respirator assembly for protection against biological hazards, which comprises:

(a) a hood capable of enclosing the head and neck of a human user, said hood comprising a material capable of heat and moisture vapor transmission but which prevents the transmission of particulates and liquids therethrough, said material also being elastic and conforming to the shape of the head and neck of said user;

(b) at least one transparent lens positioned within said hood at the level of the eyes of the user;

(c) at least one filter assembly positioned within and extending through said hood, said filter assembly comprising a HEPA filter media retained within a screen mesh material, and an airflow deflector capable of directing air flowing through said filter assembly over a surface of said lens, said airflow deflector having a plurality of raised ridges within a plenum, said ridges and plenum directing air flowing through said filter assembly over a surface of said lens; and (d) a breathe-through airflow assembly mounted within said hood.

2. The respirator assembly of claim 1 further comprising a neckdam attached to and surrounding a lower edge of the hood.

3. The respirator assembly of claim 2 wherein the neckdam is comprised of an elastic material.

4. The respirator assembly of claim 2 wherein the neckdam is comprised of silicone rubber.

5. The respirator assembly of claim 1 wherein the hood comprises a multilayered film comprising a middle layer which is a hydrophilic, thermoplastic, urethane film and a stretchable fabric bonded on each side of the urethane film, which stretchable fabric comprises nylon and an elastomer.

6. The respirator assembly of claim 1 comprising a pair of filter assemblies, one on each lateral side of the transparent lens.

7. The respirator assembly of claim 1 wherein the airflow assembly comprises a nosecup assembly.

8. The respirator assembly of claim 7 wherein the nosecup assembly surrounds and conforms to the nose and mouth of a user.

9. The respirator assembly of claim 8 wherein the nosecup assembly comprises a centrally located exhalation valve assembly and a pair of inhalation valve assemblies, one inhalation valve assembly mounted on each side of the exhalation valve assembly.

10. A hood respirator assembly for protection against biological hazards, which comprises:

(a) a hood capable of enclosing the head and neck of a human user, said hood comprising a material capable of heat and moisture vapor transmission but which prevents the transmission of particulates and liquids therethrough, said material also being elastic and conforming to the shape of the head and neck of said user;

(b) at least one transparent lens positioned within said hood at the level of the eyes of the user;

(c) a pair of filter assemblies, one on each lateral side of the transparent lens, positioned within and extending through said hood, said filter assemblies having a low-profile fit and comprising a HEPA filter media retained within a screen mesh material, and an airflow deflector, wherein said airflow deflector includes a plurality of raised ridges within a plenum, which ridges and plenum direct air flowing through the filter assembly over a surface of the lens;

(d) a breathe-through airflow assembly, said airflow assembly comprising a nosecup assembly which surrounds and conforms to the nose and mouth of the user, said nosecup assembly comprising a centrally located exhalation valve assembly and a pair of inhalation valve assemblies, one inhalation valve assembly mounted on each side of the exhalation valve assembly; and (e) a neckdam attached to and surrounding a lower edge of the hood.

11. The respirator assembly of claim 10 wherein the neckdam is comprised of an elastic material.

12. The respirator assembly of claim 10 wherein the neckdam is comprised of silicone rubber.

13. The respirator assembly of claim 10 wherein the hood comprises a multilayered film comprising a middle layer which is a hydrophilic, thermoplastic, urethane film and a stretchable fabric bonded on each side of the urethane film, which stretchable fabric comprises nylon and an elastomer.

14. The respirator assembly of claim 10 wherein the neckdam is comprised of an elastic material; wherein the hood comprises a multilayered film comprising a middle layer which is a hydrophilic, thermoplastic, urethane film and a stretchable fabric bonded on each side of the urethane film, which stretchable fabric comprises nylon and an elastomer and wherein the hood conforms to the shape of the head and neck of a human user.

* * * * *